United States Patent [19]

Kranz et al.

[11] 4,109,884

[45] Aug. 29, 1978

[54] APPARATUS AND METHOD FOR STORING PRESSURE GAS IN A RESERVOIR OF A PROJECTILE

[75] Inventors: Walter Kranz, Taufkirchen; Lynn Hohnecker, Munich, both of Fed. Rep. of Germany

[73] Assignee: Messerschmitt-Bölkow-Blohm GmbH, Fed. Rep. of Germany

[21] Appl. No.: 764,801

[22] Filed: Feb. 2, 1977

[30] Foreign Application Priority Data

Feb. 12, 1976 [DE] Fed. Rep. of Germany ..... 2605428

[51] Int. Cl.[2] ..... F42B 15/18

[52] U.S. Cl. ..... 244/3.22

[58] Field of Search ..... 244/3.1, 3.21, 3.22

[56] References Cited

U.S. PATENT DOCUMENTS

| | | | |
|---|---|---|---|
| 2,821,924 | 2/1958 | Hansen et al. | 244/3.28 |
| 2,822,755 | 2/1958 | Edwards et al. | 244/3.22 |
| 2,965,334 | 12/1960 | McCullough, Jr. et al. | 244/3.22 |
| 3,086,467 | 4/1963 | Gallagher et al. | 244/3.1 |
| 3,088,407 | 5/1963 | Gallagher et al. | 244/3.1 |
| 3,245,352 | 4/1966 | Summers | 244/3.21 |

*Primary Examiner*—Verlin R. Pendegrass
*Attorney, Agent, or Firm*—McGlew and Tuttle

[57] ABSTRACT

A pressure gas reservoir for supplying pressure gas to control mechanisms of a projectile which is to be discharged from a gun tube by means of a propellant charge comprises a projectile body which has a reservoir therein with a wall portion which is adapted to be exposed to the pressure gases of the propellant charge and includes check valve means in the wall portion permitting the inflow of the pressure gases into the reservoir during firing for the storage therein, and for the subsequent use in operating the control mechanism. The method of operating the control mechanism of a projectile which is discharged from a gun tube, includes a projectile which has a pressure reservoir and comprises using a propellant charge in the gun tube to discharge the projectile from the gun tube and directing a portion of the gases generated by the propellant charge into the reservoir during the discharge of the projectile from the gun tube and, subsequently, using the gases in the reservoir for the control of an operating function of the projectile.

3 Claims, 1 Drawing Figure

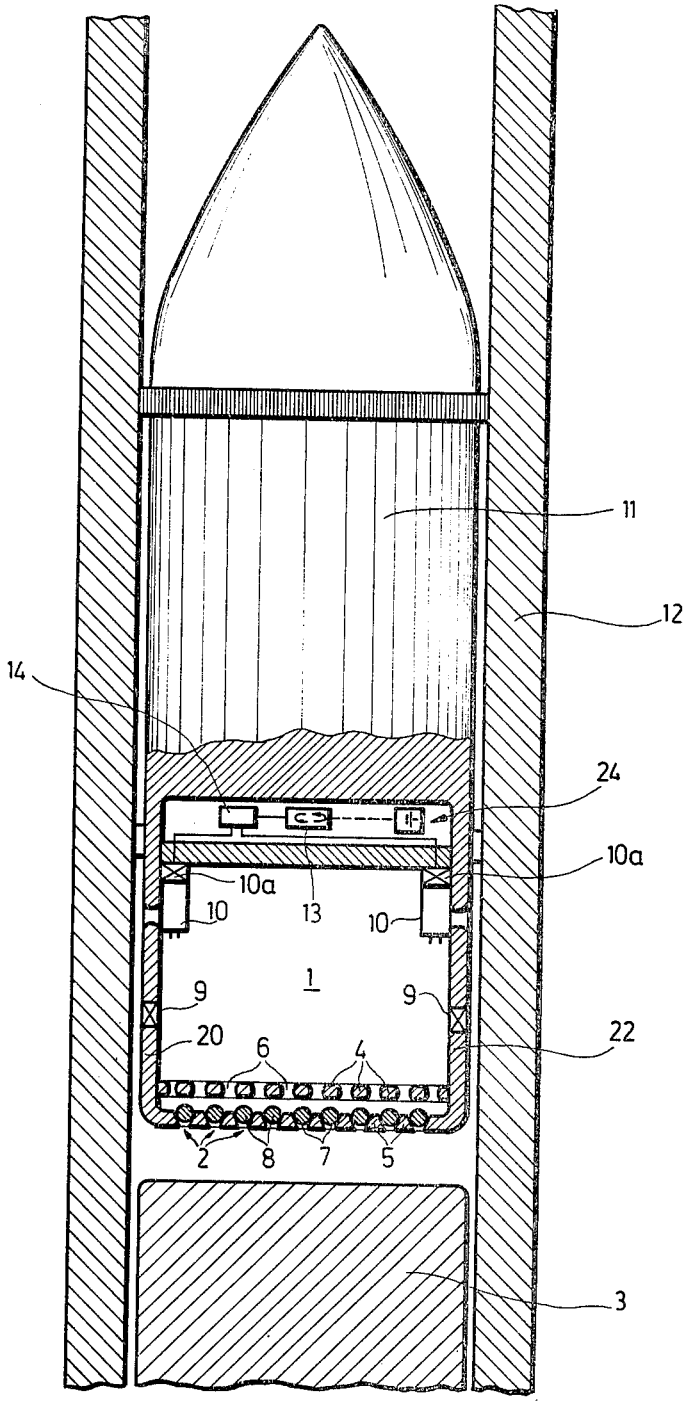
11
12
14
24
10a
10a
13
10
10
1
9
9
20
6
4
22
2
8
7
5
3

APPARATUS AND METHOD FOR STORING PRESSURE GAS IN A RESERVOIR OF A PROJECTILE

FIELD AND BACKGROUND OF THE INVENTION

This invention relates in general to the construction of missiles and projectiles and, in particular, to a new and useful method and apparatus for storing gases for use in control devices of a projectile during a time at which the projectile is discharged from a gun barrel by the ignition of a propellant charge.

DESCRIPTION OF THE PRIOR ART

The present invention relates to a pressure gas reservoir for supplying pressure gas to control mechanisms of a projectile which is to be discharged from a gun tube by means of a propellant charge. The use of pressure gas reservoirs filled with nitrogen under a pressure of approximately 50 bar in projectiles, for supplying pressure gas to secondary systems, such as open and closed-loop control mechanisms which, in turn, control nozzles for adjusting the roll rate and orientation of the projectile is well known, ("Final Report, Fluidic Roll Rate Control System for High Acceleration Terminal Homing Missiles," General Electric Company, April, 1974). The nozzles themselves are supplied with pressure gas under a pressure of about 60 bar from a hot gas generator. Such hot gas generators comprise substantially a pressure chamber and a solid charge received therein which is ignited by an ignition device and burns down to gaseous substances. Since the combustion cannot be interrupted and, in addition, the burning rate of such solid charges is largely a function of pressure, an expensive pressure control is necessary in order to avoid an explosion of the hot gas generator. Also, all devices, even after long storage and at temperatures between −40° C. and +70° C., must be capable of withstanding the high acceleration forces (up to 12,000 g) during the discharge of the projectile and then operate regularly. Up to the present time, a solution of the pressure gas supply, particularly of discharge nozzles, which satisfies all requirements, has not been found, as may be learned from the above mentioned "Final Report."

SUMMARY OF THE INVENTION

The present invention is directed to a pressure gas supply system having a reliably operating pressure gas source which is inexpensive to manufacture and suitable for supplying all the pressure gas consuming systems in a projectile. In accordance with the invention, a pressure gas reservoir is provided which is filled by establishing communication, through at least one valve, between the gas reservoir and the propellant charge of the projectile.

Thus, such a pressure gas reservoir is filled only during the discharge phase of the projectile, with the gases which are produced by the combustion of the propellant charge of the projectile. No particular ignition or pressure control devices are necessary for this purpose. Small leaks which in conventionally filled pressure gas reservoirs lead to a considerable pressure loss or complete exhaustion of the reservoir after short periods of storage, may be disregarded in view of the short flight period of the projectile. Depending on the dimensions of the inlet valve, the inventive pressure gas reservoir is filled up to a pressure of about 3000 bar which corresponds approximately to the average pressure in a gun tube for the projectile during the dicharge phase. With such high pressures, a correspondingly small reservoir can be provided.

In a particularly advantageous design of the inventive pressure gas reservoir, one wall of the reservoir forms the bottom of the projectile and is provided with an aperture in which a check valve is received.

Since the filling time is limited to the discharge phase, and the acceleration of the projectile is high during this period of time, it is particularly advantageous to provide a projectile bottom having an inner and an outer wall, which walls are parallel to and spaced from each other by a definite distance and both are provided with apertures which are offset relative to one another. The apertures of the outer wall are closable by means of loose closing bodies which are received between the two walls and have a diameter which is larger than the spacing between the walls.

The smaller the mass of the individual closing bodies, the shorter the opening and closing times, and the longer the available filling time. The reduction of the inlet cross-section resulting from the use of smaller valve bodies can be substantially compensated by an increased number of valves.

Since the propellant charge of the projectile is sometimes dimensioned in accordance with the intended range and, consequently, the pressure in the gun barrel may vary, it may be advantageous to provide the pressure gas reservoir with an excess-pressure valve to prevent the pressure in the reservoir from exceeding an adjustable maximum value.

Accordingly, it is an object of the invention to provide a pressure gas reservoir for supplying pressure gas to control mechanisms of a projectile to be discharged from a gun tube by means of a propellant charge, which comprises a projectile body which has a reservoir therein with a wall portion which is adapted to be exposed to the pressure gases of the propellant charge and which includes check valve means in the wall portion which permits the inflow of the pressure gases into the reservoir during firing for the storage therein and for the subsequent use in operating the control mechanism.

A further object of the invention is to provide a method of operating the control mechanism of a projectile which is discharged from a gun tube, which projectile has a pressure reservoir which comprises using a propellant charge in the gun tube to discharge the projectile from the gun tube and directing a portion of the gases generated by the propellant charge into the reservoir during the discharge of the projectile from the gun tube, and subsequently, using the gases in the reservoir for the control of an operating function of the projectile.

A further object of the invention is to provide a pressure gas reservoir construction for supplying pressure gases to control mechanisms of a projectile which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is a partial cross-sectional view of a gun tube with a projectile therein constructed in accordance with the invention.

Referring to the drawing in particular, the invention embodied therein comprises a projectile 11 received in a gun tube 12 which is provided with a pressure gas reservoir 1, constructed in accordance with the invention, for supplying control mechanisms 10 with compressed gas. The bottom of the projectile is formed by a double wall construction including inner and outer walls 4 and 5. The walls 4 and 5 form a bottom of the pressure gas reservoir 1 which is located adjacent a propellant charge 3.

The two walls 4 and 5 of the projectile bottom are provided with apertures 6 and 7, respectively, which are mutually offset so that each aperture 7 of the outer wall 5 faces a solid land of inner wall 4. Apertures 7 of outer wall 5 are funnel-shaped and open toward the inner wall and are closed in the outward direction by means of spherical closing bodies 8. The spacing between the two walls 4 and 5, the conical shape of apertures 7, and the diameter of each closing body 8 are dimensioned so that the closing body 8 can clear the associated aperture 7, but cannot be displaced beyond the immediate vicinity of this aperture. In this arrangement, apertures 7 in connection with closing bodies 8 define check valve means 2 which is controlled by the difference of pressures within and outside of the pressure gas reservoir.

Closing bodies 8 are lifted from the apertures 7 by the gas pressure acting on the projectile bottom after ignition of propellant charge 3. The pressure increases rapidly within a short period of time and the closing bodies 8 are lifted from apertures 7 so that gas can flow into the interior of the pressure gas reservoir. Simultaneously, the projectile in the gun barrel is accelerated and the gas pressure in the barrel decreases. As soon as the pressure acting on the outside of the projectile bottom drops below the pressure dammed up within the pressure gas reservoir, closing bodies 8 are again pressed into apertures 7 and close them. The pressure thus obtained in the pressure gas reservoir depends substantially on the pressure development in the gun tube and on the number, resistance to flow, and lifting and closing velocity of the bodies 8 of the check valve means 2. In addition, the upper limit of pressure in the pressure gas reservoir may be controlled by one or more excess-pressure valves 9 in walls of the reservoir 1, such as, side walls 20 and 22.

In order to influence the rolling, pitching, and yawing motions of a projectile which is discharged with twist, control nozzles 10, arranged diametrically oppositely in pairs on the periphery of the reservoir, which are oriented tangentially or radially relative to the projectile body 11, depending on their function, are operated with the pressure gas from pressure gas reservoir 1. Each control nozzle is provided with a solenoid valve **10*a* which is switched by means of a control system 24. For control of the rolling motion of the projectile, this control system 24 comprises substantially a sensor 13 which determines the rolling motion of the projectile and delivers an analog voltage signal to a voltage-to-frequency converter 14. From converter 14, the solenoid valves 13*a* of the control nozzles 10** are actuated in a pulsatory manner. A control nozzle suitable for this purpose is known from the firm Chandler Evans (prospectus: "Hot-Gas-Reaction-Control-System," Missile Flight Control Systems by Chandler Evans, West Hartford, Connecticut 06101, U.S.A), and a suitable sensor from the firm Hamilton Standard (Prospectus: "Superjet Solid State Rate Sensor" Hamilton Standard Division of United Aircraft Corp., Trumbull, Connecticut 06611, U.S.A).

Corresponding sensors and nozzles for determining and varying the orientation of the longitudinal axis of the projectile relative to the flight trajectory are provided for influencing the pitching and yawing motions of the projectile.

Instead of control nozzles, however, pressure-gas-piston actuated control surfaces could also be used for controlling the rolling, pitching, and yawing motions of the projectile. Such systems require a smaller amount of pressure gas for the control than control nozzles, but are a little more expensive.

In accordance with the method of the invention, the control mechanism of the projectile is operated from gases which are obtained by the ignition of a propellant charge and the collecting of the propellant charge gases in the gun tube during firing and the directing of these gases into the reservoir defined within the missile body during the discharge of the projectile from the gun tube and subsequently using the gases which have been stored in the reservoir for the control of an operating function of the projectile.

While a specific embodiment of the invention has been shown and described in detail to illustrate the application of the principles of the invention, it will be understood that the invention may be embodied otherwise without departing from such principles.

What is claimed is:

1. A pressure gas reservoir for supplying pressure gas to control mechanisms of a projectile to be discharged from a gun tube by means of a propellant charge, comprising a projectile body having wall means defining a reservoir within said projectile body with a wall portion adapted to be exposed to the pressure gases of the propellant charge, check valve means in said wall portion permitting inflow of pressure gas into said reservoir during firing for the storage of the gases in the reservoir for use in operating the control mechanism, said wall portion comprising a bottom having an inner wall and an outer wall spaced from said inner wall, said inner and outer walls being substantially parallel and each wall having a plurality of apertures which are offset in respect to the apertures of the other wall, said check valve means comprising a closing body disposed in each of said apertures of the outer one of said walls of a size to be movable between said walls to open the apertures but having a diameter which is larger than the spacing between the walls, a control nozzle mounted on said wall means, and a pressure operated control device connected to said control nozzle for opening and closing said control nozzle.

2. A pressure gas reservoir, according to claim 1, including a spring-loaded excess-pressure valve in said wall means permitting the relief of said reservoir upon the pressure exceeding a predetermined value.

3. A method of operating a control mechanism of a projectile which is discharged from a gun tube and which has a pressure reservoir, comprising igniting a propellant charge in the gun tube to generate pressure gases for the discharge of the projectile from the gun tube, directing a portion of the propellant charge gases into the reservoir through check valves during the discharge of the projectile from the gun tube, and subsequently, using the gases in the reservoir for operating a control nozzle and for furnishing gases for a control nozzle which discharges through a side wall of the reservoir, wherein the gas pressure in a reservoir is maintained at a predetermined maximum value by the use of pressure relief valves.

* * * * *